United States Patent [19]

Murphy et al.

[11] 4,371,224

[45] Feb. 1, 1983

[54] SINGLE TURRET MACHINE FOR FABRICATING HIGH-INTENSITY DISCHARGE ARC TUBES

[75] Inventors: John J. Murphy, Livingston; John Petro, Belleville; Melvin C. Unglert, Wyckoff, all of N.J.

[73] Assignee: Westinghouse Electric Corp., Pittsburgh, Pa.

[21] Appl. No.: 219,695

[22] Filed: Dec. 24, 1980

[51] Int. Cl.[3] ..... H01J 9/32; H01J 9/48

[52] U.S. Cl. ..... 316/32; 29/25.2

[58] Field of Search ..... 29/25.19, 25.2; 316/19, 316/30, 31, 32

[56] References Cited

U.S. PATENT DOCUMENTS

| | | | |
|---|---|---|---|
| 2,892,665 | 6/1959 | Fraser | 316/32 |
| 3,005,674 | 10/1961 | Fraser | 316/32 |
| 3,073,985 | 1/1963 | Fraser | 313/184 |
| 3,210,822 | 10/1965 | Lenz et al. | 29/25.19 |
| 3,305,289 | 2/1967 | Fridrich | 316/21 |
| 3,348,588 | 10/1967 | Ayotte | 141/61 |
| 3,550,227 | 12/1970 | Weigel et al. | 29/25.19 |

*Primary Examiner*—Kenneth J. Ramsey

*Attorney, Agent, or Firm*—R. S. Lombard

[57] ABSTRACT

A high-speed integral machine for fabricating substantially contaminant-free, high-intensity discharge arc tubes. The machine comprises a turret having a plurality of arc tube body holding members mounted about the peripheral portion of the turret. A plurality of work stations are located about the periphery of the turret. The turret is indexed in a stop-and-go fashion so that each of the plurality of arc tube holding members is sequentially indexed from work station to work station. Utilizing this device the fabricating operations for high-intensity discharge arc tubes are completed on one turret without substantial cooling of the arc tube between fabricating steps and the possible introduction of impurities therein.

1 Claim, 11 Drawing Figures

SINGLE TURRET MACHINE FOR FABRICATING HIGH-INTENSITY DISCHARGE ARC TUBES

CROSS-REFERENCE TO RELATED APPLICATIONS

In copending application Ser. No. 219,713, filed concurrently herewith, by J. J. Murphy and L. D. Estrada and assigned to the present assignee, there is described a rotatable turret having a constant index time and a variable dwell time. The turret is used for the production of worked pieces.

In copending application Ser. No. 219,696, filed concurrently herewith, now U.S. Pat. No. 4,329,166, by J. J. Murphy and assigned to the present assignee, there is described an automatic tipping-off apparatus for hermetically sealing a dosed and otherwise processed arc tube for a high-intensity-discharge arc tube.

In copending application Ser. No. 219,693, filed concurrently herewith, now U.S. Pat. No. 4,319,906, by P. Fix and K. Collins and assigned to the present assignee, there is described an apparatus for press-sealing a tubular quartz body portion about a ribbon-type metallic seal. The press-sealing apparatus utilizes a burner that deforms the tubular quartz body portion in such a manner to provide sufficient quartz for the press seal.

In copending application Ser. No. 219,712, filed concurrently herewith, now U.S. Pat. No. 4,309,169, by J. Petro and assigned to the present assignee, there is described a machine parts protecting system for protecting those parts of a machine that may be in close proximity to high-temperature flames.

BACKGROUND OF THE INVENTION

The present invention relates to fabricating machinery for manufacturing high-intensity-discharge devices and, in particular, to a machine for fabricating a high-intensity-discharge arc tube such as a mercury vapor arc tube.

One such machine is disclosed in an Article entitled "High-Pressure Mercury Vapor Lamp Machinery" in an advertising brochure of the Betamax Company on page 7 thereof. The Article describes fabricating machinery for making high-intensity-discharge (HID) arc tubes consisting of one 20-head pinch sealing machine that seals the electrodes into the arc tube prior to exhausting and a 48/24-head two-stage high-pressure mercury-vapor arc tube exhaust machine consisting of a 48-head turret where the quartz arc tubes are initially evacuated during a recycle of the 48-head turret and are filled above atmospheric pressure with argon gas an dosed with mercury. The arc tubes are then transferred automatically to a 24-head turret during a cycle of which the final evacuation and sealing operations are carried out.

Such apparatus including rotatable turrets is common in the lamp-making industry. Another example of a lamp-making machine utilizing a rotatable turret is disclosed in U.S. Pat. No. 3,210,822, dated Oct. 12, 1965, issued to C. Lenz et al. The Lenz patent discloses a machine for fabricating the stems for electric lamps or other electronic devices utilizing flares, tubulations and lead-in wires to be assembled as a complete stem. The machine includes a turret which is driven to index in a step-by-step rotation and carries a plurality of heads next to its periphery. The heads are arranged in a circular series with minimum spacing between one another such that with each indexing motion of the turret a next succeeding head is moved into the position vacated by the preceding head. At each position there is an operating station where work is performed on the stems. Another such lamp-making apparatus utilizing a rotatable turret is disclosed in U.S. Pat. No. 3,550,227, dated Dec. 29, 1970, issued to R. V. Weigel et al. The Weigel patent discloses a machine for forming a filament and mount structure on the glass reflector sections of projector-type electric incandescent lamps comprising an indexing carried (turret) having a series of heads thereon each comprising a holder for supporting a reflector section and a movable carriage for holding a plurality of lead-in conductors. This machine provides an improved and fully automatic apparatus for forming the mount structures on the reflector sections of projector-type electric incandescent lamps at a high-production rate.

SUMMARY OF THE INVENTION

There is provided a high-speed integral machine for fabricating substantially contaminant-free high-intensity-discharge arc tubes. The machine comprises rotary lamp-making means comprising a turret. A plurality of arc tube body holding members each mounted on and about the peripheral portion of the turret. A plurality of work stations is located about the periphery of the turret. Driving means is included for driving the turret and indexing each of the plurality of arc tube holding members in a stop-and-go fashion so that each of the plurality of arc tube holding members is sequentially indexed from work station to work station.

The arc tubes as fabricated each include a tubular quartz body having a first electrode assembly press-sealed at one end thereof and a second electrode assembly press-sealed at the other end thereof. The electrode assemblies each comprise an electrode affixed to one end of a ribbon-type metallic seal means. A predetermined discharge-sustaining filling is contained within the arc tube body as fabricated. The arc tube body in an intermediate stage of fabrication has an exhaust tubulation projecting laterally therefrom and opening into the interior thereof.

The machine operates to receive each arc tube individually and to separately fabricate the same. The machine comprises a first work station means operating to load each first electrode assembly and the arc tube body onto one of the arc tube body holding members. A second of work station means heats the one end of the loaded arc tube body and inserting the first electrode assembly and presses the heated end of the loaded arc tube body to rigidly secure the first electrode assembly and seal the heated end of the loaded arc tube body while purging the arc tube body with an inert gas. A third work station means operates to heat the other end of the loaded arc tube body and insert the second electrode assembly and press the heated other end of the arc tube body to rigidly secure the second electrode assembly and seal the other end of the arc tube body while purging the arc tube body with an inert gas. A fourth work station means operates to exhaust the arc tube body while still hot. A fifth work station means repeatedly fills the arc tube with an inert gas and creates an arc discharge between the electrodes and exhausts the arc tube body to substantially remove any contaminants. A sixth work station means partially cools the arc tube body while exhausting the same. A seventh work station means doses the arc tube body with a predetermined amount of mercury and repeatedly fills the arc tube body with an inert gas and then exhaust the inert gas. An eighth work station means overfills the arc tube body with an inert gas to a pressure greater than the final desired fill pressure and then bleeds the inert gas from the overfilled arc tube body to achieve the final desired fill pressure. A ninth and final of the work station means tips-off the exhaust tubulation from the arc tube body and removes the residual tip from the arc tube body member and unloads the completed arc tube from the arc tube body holding member, whereby all fabricating operations are completed on one turret without substantial cooling of the arc tube between fabricating steps and the possible introduction of impurities therein.

BRIEF DESCRIPTION OF THE DRAWINGS

For a better understanding of the invention, reference may be had to the following drawings, exemplary of the invention in which.

DESCRIPTION OF THE PREFERRED EMBODIMENTS

The present invention overcomes the problems of the prior art processes which use at least two separate machines: one for press-sealing and another for exhausting the arc tube body and filling. The delay between the press-sealing of the arc tube body and the exhausting of the arc tube body and subsequent filling with the desired fill gas has always been a source of possible contamination and questionable quality and has usually required an additional heating of the arc tube body and a sophisticated exhaust scheme in order to manufacture a quality product. More handling is required to unload the press-seal machine and transport and load the exhaust machine. In addition, when the tube is reheated during the exhaust process, the molybdenum lead-in wires tend to be badly oxidized, reduced in diameter and require an acid wash to remove moly-oxide deposits on the quartz of the arc tube body and to make the lead-in wires weldable. A minimum time for processing an arc tube body using prior art processes is about one-half hour. The present invention completes the fabrication of an arc tube body in about four minutes.

Figure 1:
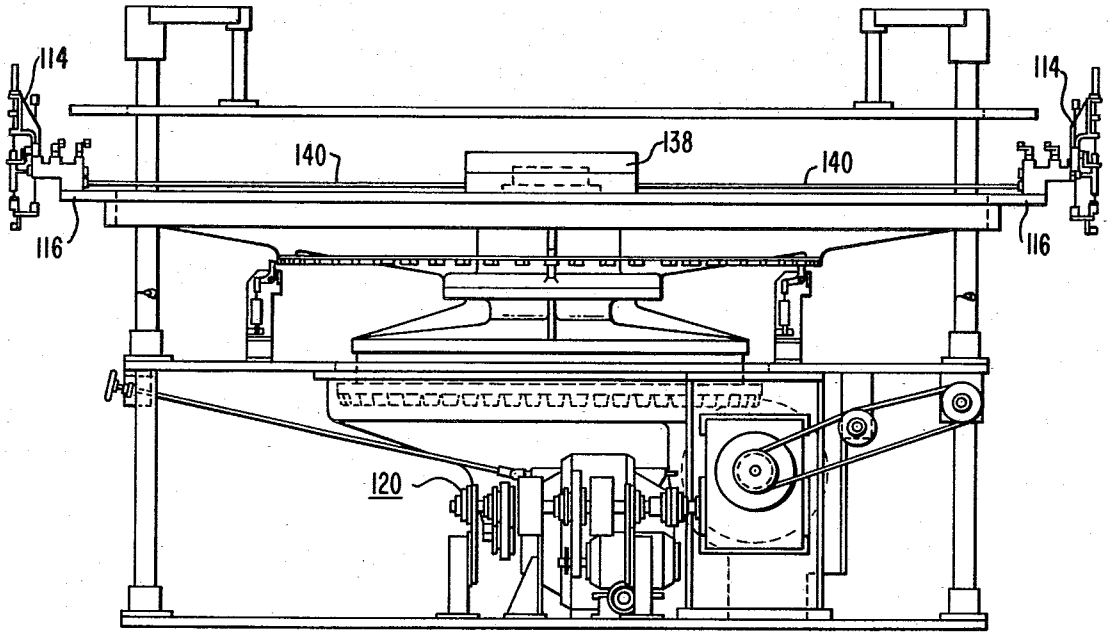
FIG. 1 is an elevational view of the turret, with only two arc tube holding members and associated sweeps shown, the position of the turret relative to the driving means is also shown.
Figure 2:
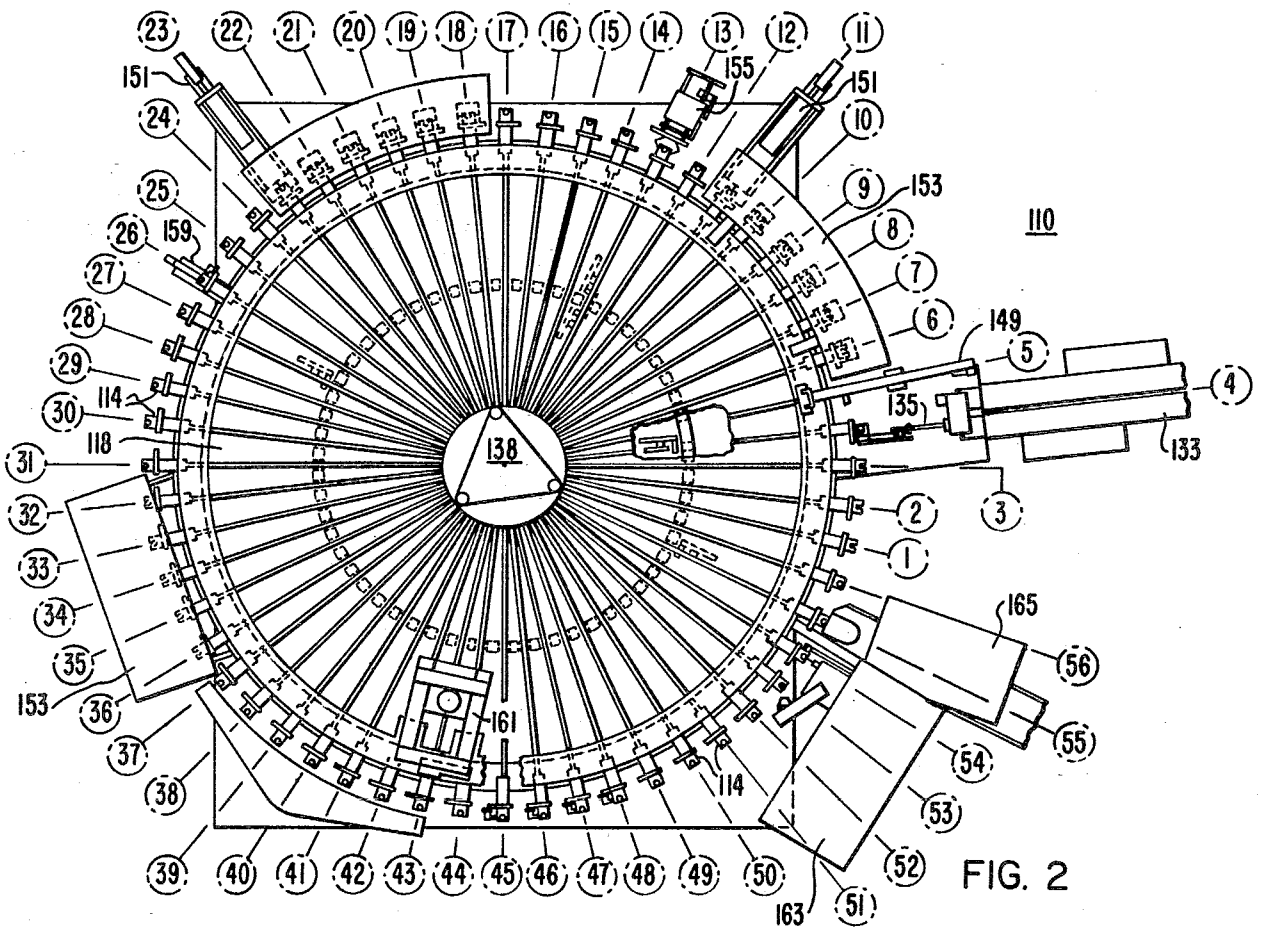
FIG. 2 is a plan view of the high-speed integral machine with the work station means indicated schematically.
Figure 3A:
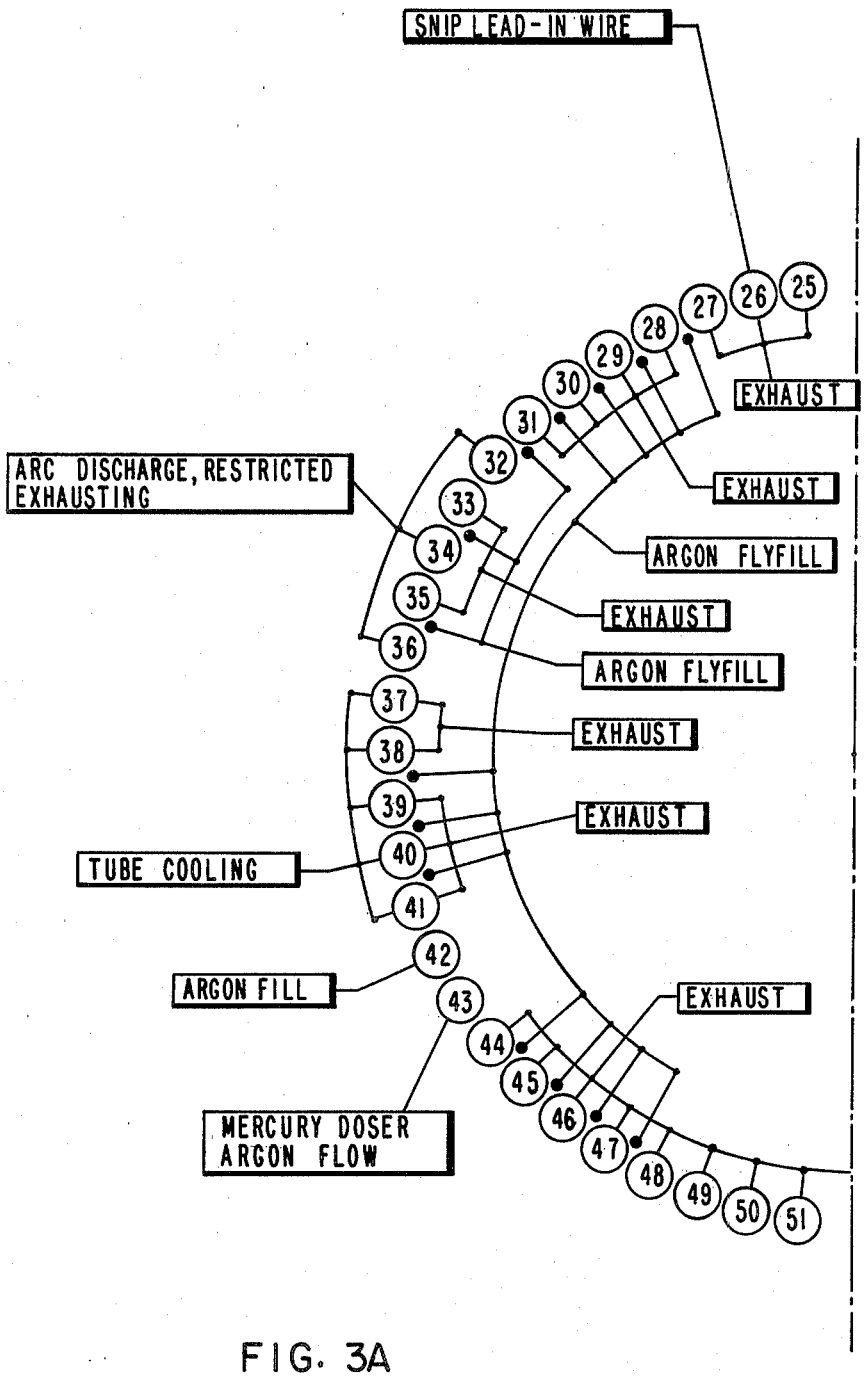
FIGS. 3A and 3B show a diagrammatic plan view showing the plurality of work station means and their functions located about the periphery of the turret; in addition, the operations performed on the atmosphere within the arc tube body are also indicated.
Figure 3B:
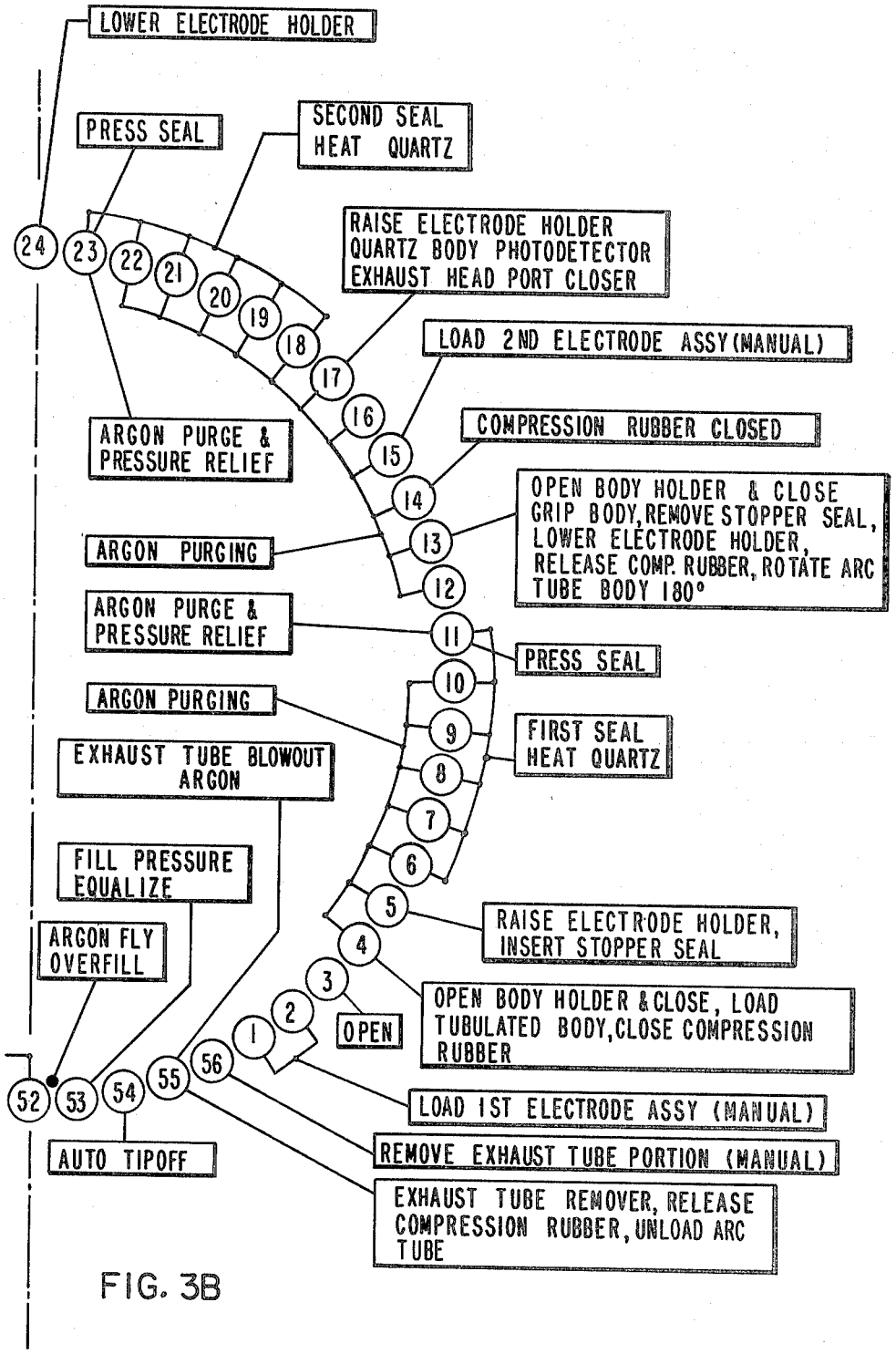
Figure 4:
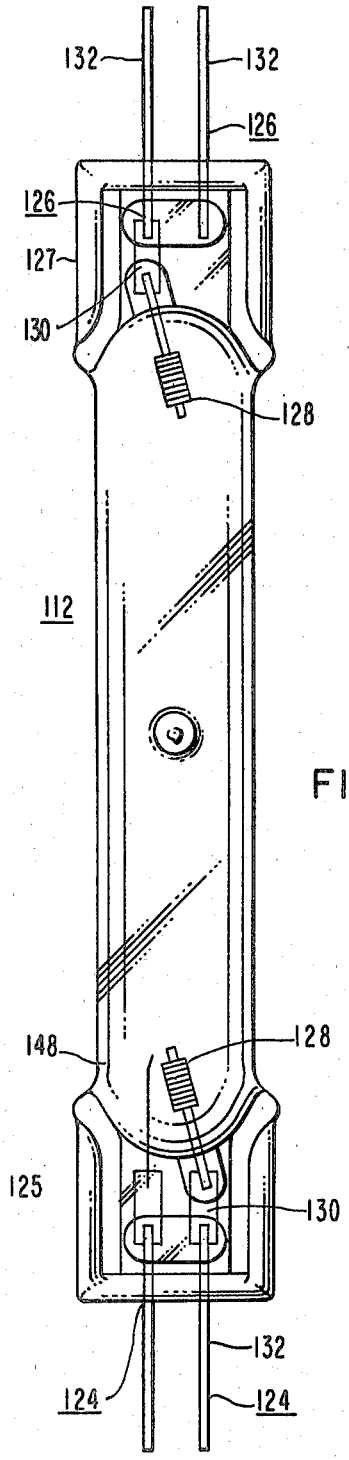
FIG. 4 is an elevational view of a fabricated high-intensity-discharge arc tube.
Figure 7:
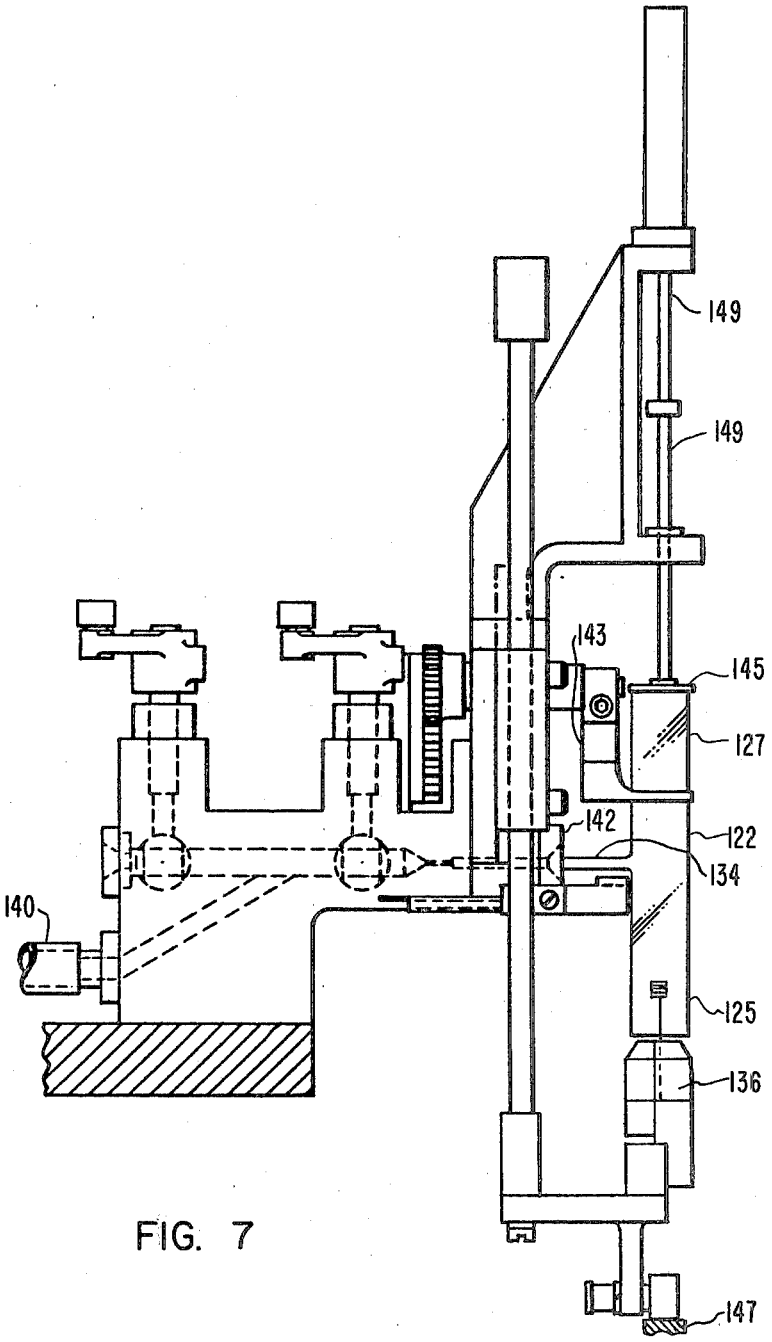
FIG. 7 is an elevational view of an arc tube body holding member holding an arc tube body in an intermediate stage of fabrication having an exhaust tubulation projecting laterally therefrom and opening into the interior thereof.
Figure 8:
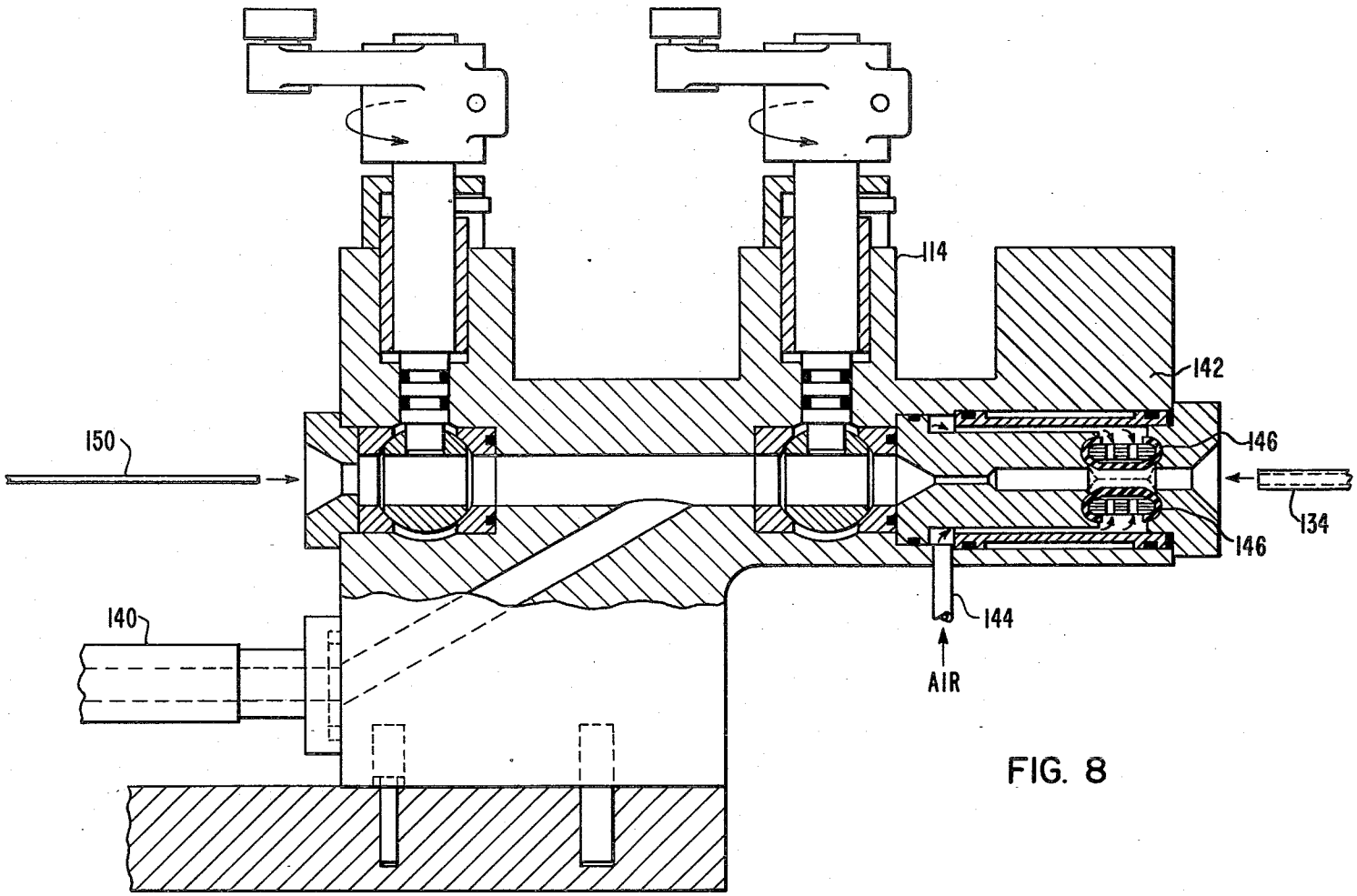
FIG. 8 is an enlarged cross-sectional elevational view showing a portion of an arc tube body holding member.

With reference to FIGS. 1–3B there is provided a high-speed integral machine 110 for fabricating substantially contaminant-free, high-intensity discharge arc tubes 112 such as shown in FIG. 4. A plurality of arc tube body holding members 114, see FIGS. 7 and 8, is each mounted on and about the peripheral portion 116 of a turret 118. For a further detailed explanation of the operation of the arc tube body holding member 114 reference may be had to the aforesaid copending application Ser. No. 219,693, now U.S. Pat. No. 4,319,906.

A plurality of work station means 1–56 are located about the periphery of the turret 118. Driving means 120 drives the turret 118 and indexes each of the plurality of arc tube holding members 114 in a stop-and-go fashion so that each of the plurality of arc tube holding members 114 is sequentially indexed from work station means to work station means. For further detailed explanation of the driving means 120 reference may be had to the aforesaid copending application Ser. No. 219,713, filed concurrently herewith.

Figure 5:
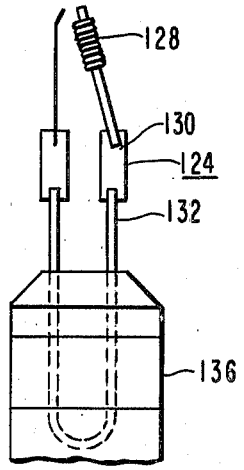
FIG. 5 is an elevational view of the first electrode assembly in position within an electrode assembly holding member.
Figure 6:
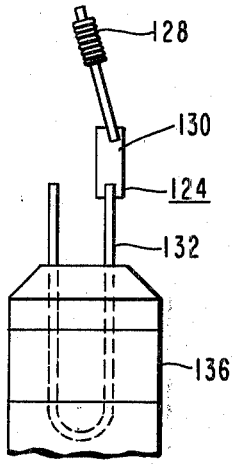
FIG. 6 is an elevational view of the second electrode assembly in position in an electrode assembly holding member.

The arc tubes 112 as fabricated each include a tubular quartz body as shown in FIG. 4. The arc tube body 122 has a first electrode assembly 124, shown in FIG. 5, press-sealed at one end of the arc tube body 122. Second electrode assembly 126, as shown in FIG. 6, is press-sealed at the other end 127 of the arc tube body 122. The electrode assemblies 124 and 126 each comprise an electrode 128 affixed to one end of a ribbon-type metallic seal means 130. The electrode assemblies also include lead-in wires 132 affixed to the ribbon-type metallic seal means 130. The ribbon-type metallic seal means 130 and the lead-in wires 132 are typically made of molybdenum. A predetermined discharge-sustaining filling is contained within the arc tube body 122 as fabricated. The discharge-sustaining filling typically comprises an inert gas such as argon. The arc tube body 122 during fabrication has an exhaust tubulation 134, as shown in FIG. 7, projecting laterally therefrom and opening into the interior thereof.

The high-speed machine 110 operates to receive each arc tube 112 individually and to separately fabricate the same. A first of the work station means 1–4, shown in FIG. 3B, operates to load each of the first electrode assemblies 124 and the arc tube body 122 onto one of the arc tube body holding members 114. As shown in FIG. 3B the first electrode assembly is loaded manually into electrode holding member 136 which is a part of arc tube holding member 114. As indicated in FIG. 3B argon purging is initiated at work station 4. The machine 110 utilizes a rotary plate valve 138 connecting to the arc tube holding members 114 through sweep members 140 to supply the desired gas to the arc tube bodies 122 and to exhaust the arc tube bodies at predetermined times during the fabrication of the arc tube as indicated in FIGS. 3A and 3B. The rotary plate valve and sweep arrangement is well known in the art. Also at work station 4 upon the exhaust tubulation 134 being inserted into the head 142 of arc tube holding member 114, shown in FIG. 8, air pressure is supplied via tube 144 to close compression rubber 146 around the exhaust tubulation 134 thereby securely holding the tubulation 134.

The arc tube body 122 is moved into loading position via conveyor 133 and loaded on to arc tube holding member 114 by loading mechanism 135, such loading mechanisms are generally known in the art, alternatively, the loading may be done manually.

The second of the work station means 5–11 heats the one end 125 of the loaded arc tube body 122 and inserts the first electrode assembly 124 and presses the heated end of the loaded arc tube body 122 to rigidly secure the first electrode assembly 124 and seal the heated end 125 of the loaded arc tube body 124 while purging the arc tube body with an inert gas. As indicated in FIG. 3B in this embodiment at work station 5 the electrode holder 136 is raised by track 147 positioning the first electrode assembly 124 in position at the one end 125 of the arc tube body. At this time stopper seal 145 is lowered by stopper seal lowering mechanism 149 thereby sealing the other end 127 of the arc tube body 122, such stopper seal mechanisms are generally known in the art, alternatively, the stopper seal may be inserted manually. At work stations 6–10 the one end 125 of the quartz arc tube body 122 is heated to a viscous state to permit pressing and sealing thereof at work station 11. As indicated by FIG. 3B the arc tube body 122 is purged with argon from work stations 5 to 11. At work station 11 after the press-seal is made the pressure of the argon in the arc tube is relieved in a controlled manner as known in the art to give the proper formation of cavity 148 around the electrode 128. For further detailed explanation of the press-sealing apparatus 151 reference may be had to the aforesaid copending application Ser. No. 219,693, now U.S. Pat. No. 4,319,906. An exhaust hood 153 exhausts the products of combustion from the press-sealing operation, see FIG. 2.

A third of the work station means 12–23 operates to heat the other end 127 of the loaded arc tube body 122 and inserts the second electrode assembly 126 and presses the heated other end 127 of the arc tube body 122 to rigidly secure the second electrode assembly 126 and seal the other end 127 of the arc tube body 122 while purging the arc tube body with an inert gas. As indicated in FIG. 3B at work station 12 argon purging is again initiated. At work station 13 the body holder 143 is opened, the stopper seal 145 is raised and the electrode holder 136 is lowered while the compression lever 146 is released. The arc tube body is rotated 180° either by arc tube body rotating device 155, such rotating devices are generally known in the art, alternatively, the arc tube body 122 may be rotated manually. After the arc tube body 122 has been rotated 180° body holder 143 closes to grip the body. At work station 14 compression rubber 146 is again closed. At work station 15 the second electrode assembly is loaded onto the electrode holding member 136 manually. At work station 16 the argon purging of the arc tube body is continued and at work station 17 the electrode holder 136 is raised in the same manner as described for the first electrode assembly 124. Beginning at work station 18 and through work station 23 the other end 127 of the arc tube body 122 is heated to a softened-state temperature as previously described while argon purging is continued. At work station 23 the other end 127 of the arc tube body 122 is press-sealed in the same manner as described for the press-sealing of the one end 125 of the arc tube body. Also the argon pressure in the arc tube body is relieved as already described. At work station 24 electrode holder 136 is lowered by track 147.

A fourth of the work station means 25–27 operates to exhaust the arc tube body while still hot. At work station 29 the lead wire 132 is snipped by snip mechanism 159, such snip mechanisms are generally known in the art, alternatively, the load wire 132 may be snipped manually.

A fifth of the work station means 28–36 repeatedly fills the arc tube with an inert gas and creates an arc discharge between the electrodes 128 and exhausts the arc tube body 122 to substantially remove any contaminant. As indicated in FIG. 3A argon at a predetermined pressure such as 50 Torr is admitted through a 0.5 millimeter diameter orifice during the indexing of the turret beginning at the index from station 27 to station 28 as indicated in FIG. 3A. The machine 110 is designed to index in about 0.75 seconds. As indicated in FIG. 3A beginning at work station 28 the arc tube body is repeatedly exhausted and filled with argon on the fly (while indexing) until the arc tube body is indexed to work station 32. At work station 32 an arc discharge is created between the electrodes 28 while a restricted pumping such as 8 Torr per second is continued. At work station 33 the arc tube body is again exhausted and is filled with argon between stations 33 and 34. At work station 34 another arc discharge is created and the procedure is repeated through work station 36 as indicated.

A sixth of the work station means 37–43 operates to partially cool the arc tube body 122 to a temperature of 90° C. while exhausting the same and filling with an inert gas as indicated in FIG. 3A.

A seventh of the work station means 43–52 doses the arc tube body 122 with a predetermined amount of mercury such as 35 milligrams and repeatedly fills the arc tube body with an inert gas and then exhausts the inert gas. As indicated in FIG. 3A the arc tube body is filled with argon to a predetermined pressure such as 800 mm at work station 42. The argon flow is continued at work station 43. The arc tube is dosed with mercury by insertion of mercury conduit 150 into the exhaust tubulation 134. The mercury-dosing device 161 such as disclosed in U.S. Pat. No. 3,348,588, issued to Ayotte may be used. For a detailed explanation of the functioning of that device reference may be had to the Ayotte patent. At work station 44 the arc tube body 122 is again exhausted and filled with argon while being indexed to work station 45. This process is repeated to work station 48. The exhausting of the arc tube body 122 is continued from work station 48 through 52.

Figures 9, 10:
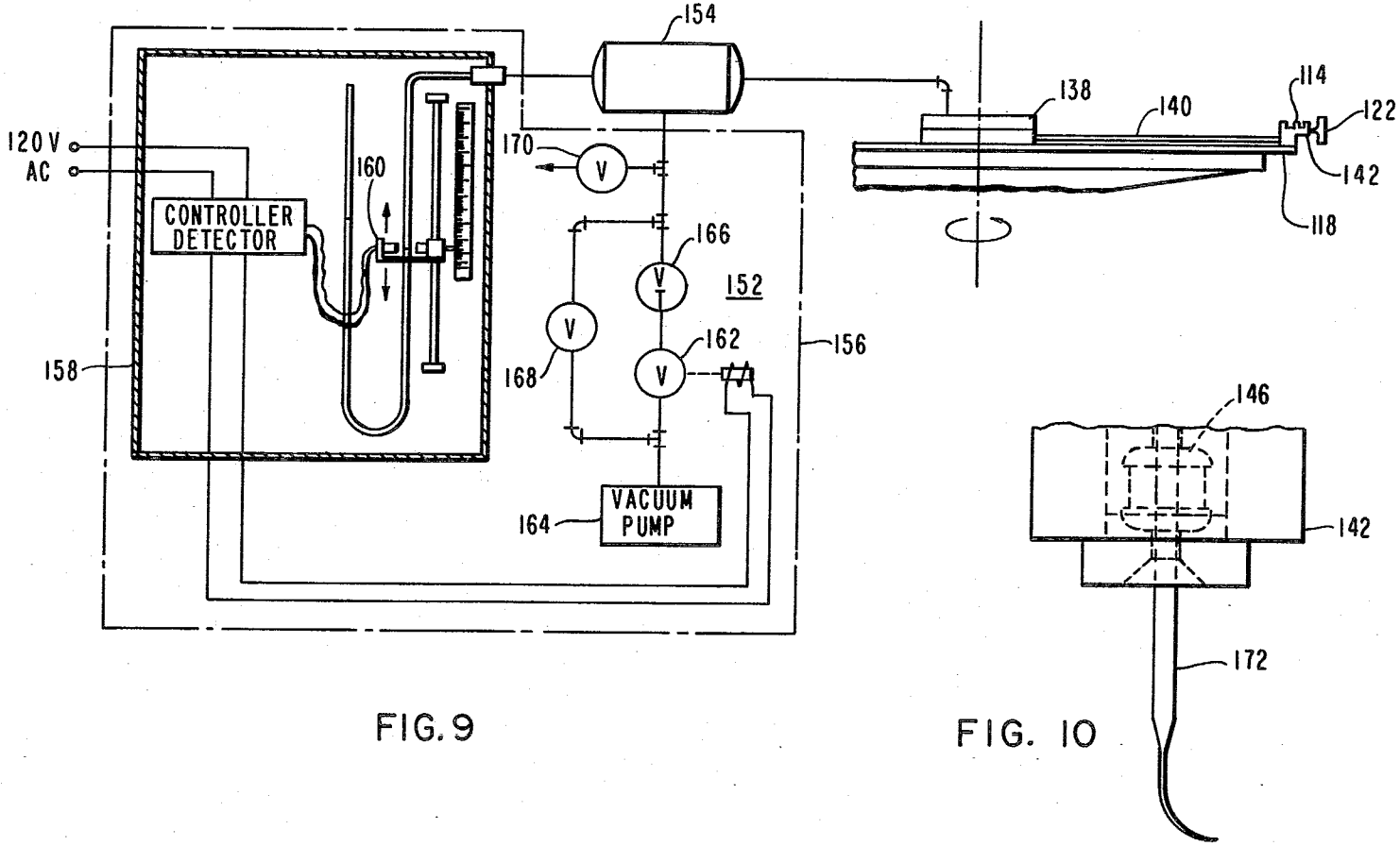
FIG. 9 is a schematic of the apparatus used for overfilling the arc tube body with an inert gas at the eighth work station means; and, FIG. 10 is an elevational view of a portion of the head holding the residual tip.

An eighth of the work station means 53 overfills the arc tube body with an inert gas to a pressure greater than the final desired fill pressure and then bleeds the inert gas from the overfilled arc tube body to achieve the final desired fill pressure. As indicated in FIG. 3B between work stations 52 and 53 the arc tube body 122 is overfilled with argon to a pressure such as 30 Torr which is greater than the final desired fill pressure 20 Torr. The bleeding of the argon from the overfilled arc tube body 122 is done with the gas-fill pressure control apparatus 152 shown in FIG. 9. The gas-fill pressure control apparatus 152 is in gaseous relationship with the arc tube body 122 through the rotary plate valve 138 and sweep 140. The control apparatus 152 includes ballast tank 154 which is maintained at the desired final fill pressure such as 20 Torr. The ballast tank 154 has an internal volume which is a predetermined number of times greater such as 800 times greater than the combined internal volume of the sweep 140, the head 142 and the arc tube body 122. Since the arc tube body is always filled to a greater pressure than the pressure of the ballast tank 154 the atmosphere in the arc tube body 122 is bled back into the tank 154. The control apparatus maintains the desired pressure for the ballast tank 154 within a predetermined incremental pressure such as 0.5 Torr of the final-fill pressure. The control apparatus includes a manometer 158 manufactured by Televac Model VCS-3 which has a setpoint which is adjustable throughout a pressure range of 0 to 120 mm and provides an accurate on-off control through a set of single-pole double-throw relay contacts. The manometer 158 is in gaseous relationship with the ballast tank 154. A photo detector 160 which is a part of the Televac unit connects in circuit with a normally closed solenoid valve 162. The solenoid valve is in gaseous relationship with the vacuum pump 164 and with the ballast tank 154. Photo detector 160 is set to detect wheh a predetermined incremental pressure by the final-fill pressure has been reached and thereupon energizes the solenoid valve 162 thereby permitting the pump 164 to pump the ballast tank down to the final-fill pressure and upon the final-fill pressure being reached the photo detector de-energizes the solenoid valve and stops the pumping of the ballast tank 154. Restriction valve 166 is included to prevent overshooting of the desired final-fill pressure. Bypass valve 168 is also included to permit quick pump down of the ballast tank. Valve 170 connects to an argon supply to permit backfilling of the ballast tank with argon to the final-fill pressure whenever desired. Utilizing this system, permits control of the final-fill pressure in the arc tube within a few tenths of a millimeter of mercury absolute pressure.

At the ninth and final work station means 54–56, the exhaust tubulation 134 is tipped-off from the arc tube body 122 and the residual tip 172 is removed, see FIG. 11, from the arc tube body holding member 114, and the completed arc tube 112 is released. The completed arc tube 112 falls into collector 165. For a detailed explanation of the operation of work station 54 where the exhaust tubulation 134 is tipped-off by tip-off apparatus 163 reference may be had to the aforesaid copending application Ser. No. 219,696, now U.S. Pat. No. 4,329,166. As indicated in FIG. 3B the residual tip 172 of the exhaust tubulation 134 is removed from the arc tube body holding member 114 at station 55 after the arc tube 112 is unloaded. This is done by releasing compression rubber 146 and blowing the residual tip 172 out of the head 172 as is known in the art. At station 56, any portion of the exhaust tubulation 134 still remaining in the head 142 is manually removed. Thus, all fabrication operations are completed on one turret without substantial cooling of the arc tube between fabricating steps and the possible introduction of impurities therein. This machine is capable of producing high-quality HID arc tubes at 1,000 units per hour and is adaptable to making all types.

We claim:

1. A high-speed integral machine for fabricating substantially contaminant-free high-intensity discharge arc tubes, said machine comprising rotary lamp-making means comprising a turret, a plurality of arc tube body holding members each mounted on and about the peripheral portion of said turret, a plurality of work station means located about the periphery of said turret, driving means for driving said turret and indexing each of said plurality of arc tube holding members in a stop-and-go fashion so that each of said plurality of arc tube holding members is sequentially indexed from work station means to work station means, said arc tubes as fabricated each including a tubular quartz body having a first electrode assembly press-sealed at one end thereof and a second electrode assembly press-sealed at the other end thereof, said electrode assemblies each comprising an electrode affixed to one end of a ribbon-type metallic seal means, a predetermined discharge-sustaining filling being contained within said arc tube body as fabricated, said arc tube body during fabrication having an exhaust tubulation projecting laterally therefrom and opening into the interior thereof, said machine operating to receive each arc tube individually and to separately fabricate same, said machine comprising:

(a) a first of said work station means operating to load each said first electrode assembly and said arc tube body onto one of said arc tube body holding members;

(b) a second of said work station means for heating one end of said loaded arc tube body and inserting said first electrode assembly and press-sealing said heated end of said loaded arc tube body to rigidly secure said first electrode assembly and seal said heated end of said loaded arc tube body while purging said arc tube body with an inert gas;

(c) a third of said work station means operating to heat the other end of said loaded arc tube body and insert said second electrode assembly and press-seal heated other end of said arc tube body to rigidly secure said second electrode assembly and seal said other end of said arc tube body while purging said arc tube body with an inert gas;

(d) a fourth of said work station means operating to exhaust said arc tube body while still hot;

(e) a fifth of said work station means for repeatedly filling said arc tube with an inert gas and creating an arc discharge between said electrodes and exhausting said arc tube body to substantially remove any contaminants;

(f) a sixth of said work station means for partially cooling said arc tube body while exhausting same and filling said arc tube body with an inert gas;

(g) a seventh of said work station means for dosing said arc tube body with a predetermined amount of mercury and repeatedly filling said arc tube body with an inert gas and then exhausting said inert gas;

(h) an eighth of said work station means for overfilling said arc tube body with an inert gas to a pressure greater than the final desired fill pressure, and then bleeding said inert gas from said overfilled arc tube body to achieve said final desired fill pressure;

(i) a ninth and final of said work station means for tipping-off said exhaust tubulation from said arc tube body and removing the residual tip from said arc tube body holding member and unloading said completed arc tube from said arc tube body holding member, whereby all fabricating operations are completed upon one turret without substantial cooling of said arc tube between fabricating steps and a possible introduction of impurities therein.

* * * * *